US010427408B2

(12) United States Patent
Tuset et al.

(10) Patent No.: US 10,427,408 B2
(45) Date of Patent: Oct. 1, 2019

(54) PRINTHEAD MAINTENANCE APPARATUS

(71) Applicant: Hewlett-Packard Development Company, L.P., Houston, TX (US)

(72) Inventors: Pere Tuset, Sant Cugat del Valles (ES); Sheila Cabello, Sant Cugat del Valles (ES); Xavier Vilajosana, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/097,983

(22) PCT Filed: Jul. 25, 2016

(86) PCT No.: PCT/US2016/043866

§ 371 (c)(1),
(2) Date: Oct. 31, 2018

(87) PCT Pub. No.: WO2018/021997

PCT Pub. Date: Feb. 1, 2018

(65) Prior Publication Data

US 2019/0143694 A1 May 16, 2019

(51) Int. Cl.

| | |
|---|---|
| ***B41J 2/165*** | (2006.01) |
| ***B41J 2/175*** | (2006.01) |
| ***B41J 2/045*** | (2006.01) |

(52) U.S. Cl.

CPC ..... *B41J 2/165* (2013.01); *B41J 2/04501* (2013.01); *B41J 2/17596* (2013.01); *B41J 2002/16502* (2013.01); *B41J 2002/16594* (2013.01)

(58) Field of Classification Search

CPC ..... B41J 2/165; B41J 2/17596; B41J 2/04501

USPC ..... 347/22, 23, 89

See application file for complete search history.

(56) References Cited

U.S. PATENT DOCUMENTS

| | | | | |
|---|---|---|---|---|
| 5,682,191 | A | 10/1997 | Barrett et al. | |
| 6,672,702 | B2 | 1/2004 | Sadasivan et al. | |
| 7,083,253 | B2 * | 8/2006 | Kimura | B41J 2/16538 347/23 |
| 2004/0246294 | A1 * | 12/2004 | Mitsuzawa | B41J 2/145 347/23 |
| 2005/0206675 | A1 | 9/2005 | Levin et al. | |
| 2008/0024565 | A1 | 1/2008 | Smith | |
| 2015/0304509 | A1 | 10/2015 | Jintsugawa et al. | |

FOREIGN PATENT DOCUMENTS

| | | | |
|---|---|---|---|
| EP | 0608104 | A2 | 7/1997 |
| JP | 2009248547 | A | 10/2009 |

OTHER PUBLICATIONS

Unknown, "Automatic Printhead Cleaning Schedule" Retried on Oct. 29, 2018, 1 page.

Unknown, "Print Head Cleaning Tips", Jul. 18, 2006, 6 pages.

* cited by examiner

*Primary Examiner* — An H Do

(74) *Attorney, Agent, or Firm* — HP Inc. Patent Department

(57) ABSTRACT

In an example, a printhead maintenance apparatus includes a pump, a current monitor and processing circuitry. The pump may be provided to increase a pressure in a printhead, and the current monitor may monitor a current consumption of the pump. The processing circuitry may determine a rate of change of current consumption of the pump, and compare the rate of change of current consumption to a predetermined threshold.

15 Claims, 4 Drawing Sheets

PRINTHEAD MAINTENANCE APPARATUS

BACKGROUND

Print apparatus utilise various techniques to disperse print agents such as coloring agent, for example comprising a dye or colorant coating agents, thermal absorbing agents and the like. Some apparatus use 'inkjet' techniques and such apparatus may comprise a printhead. An example printhead includes a set of nozzles and a mechanism for ejecting a selected print agent (for example, an ink) as a fluid, for example a liquid, through a nozzle.

BRIEF DESCRIPTION OF DRAWINGS

Non-limiting examples will now be described with reference to the accompanying drawings, in which.

DETAILED DESCRIPTION

Some print apparatus, for example inkjet printers, may encounter debris deposition and accumulation in print agent delivery tubes, print agent ejection nozzles and/or nozzle plates of a printhead. Debris deposition (for example, pigment deposition) may for example occur during long-term storage of printheads, for example during transportation from a factory to a customer, and/or due to water evaporation during printing, which may be significant in those print apparatus which heat print agents as part of the print agent ejection process. Over time, debris can render some or all of the nozzles unable to eject drops of print agent, which ultimately has an impact on image quality. Such effects may be seen in both print apparatus for printing on a substrate such as paper, card, plastic, metal and the like, and in three dimensional printing apparatus, also referred to as additive manufacturing apparatus, which may for example apply agents onto a build material (for example a powdered build material) to cause it to solidify.

In light of this, cleaning mechanisms may be used to clear the debris. In general, these mechanisms can be classified as manual or automatic. In a manual cleaning process, a printhead may be removed from an apparatus and cleaned by hand (for example being soaked or scrubbed, or having cleaning fluids forced through the printhead, and in some examples being purged using high pressure air). This process is generally effective but can be time-consuming. In automatic cleaning processes, the printhead may remain within the print apparatus, which may comprise a cleaning or maintenance apparatus to force print agent, air and/or cleaning fluids through the nozzles. These methods are generally more convenient for a user.

Verification that a cleaning operation has been successful may be determined after a cleaning operation. For example, a drop detector may be used to detect whether print agent drops are being ejected from individual nozzles of a printhead following cleaning. Such a drop detector may be used to determine whether any of the nozzles remain wholly or partially dogged.

Figure 1:
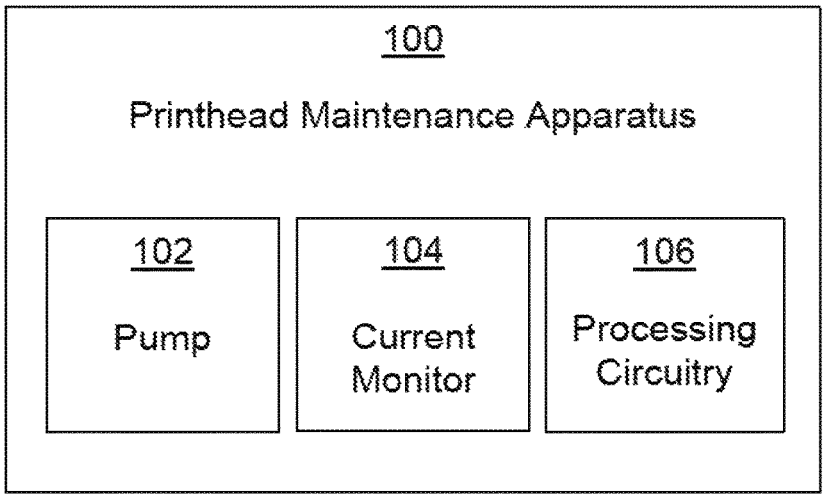
FIG. 1 is a schematic example of printhead maintenance apparatus.

FIG. 1 is an example of a printhead maintenance apparatus 100 comprising a pump 102, a current monitor 104 and processing circuitry 106. The printhead maintenance apparatus 100 may be for insertion into a print apparatus and the pump 102 is provided to operate to increase a pressure in a printhead which is inserted into that print apparatus (although, as further detailed below, the pump 102 may not always succeed in increasing the pressure in the printhead). In some examples, the pump may pump air, or some other fluid, into the printhead. For example, the pump 102 may comprise a motor linked to a turbine that rotates and blows air into the printhead, although other types of pump may be used.

The current monitor 104 is to monitor a current consumption of the pump 102 and the processing circuitry 106 is to determine a rate of change of current consumption of the pump 102 and to compare the rate of change of current consumption to a predetermined threshold. In some examples, the current monitor 104 may comprise a transimpedance amplifier circuit to convert current consumption to voltage and an analogue-to-digital converter to digitize the voltage signal, although in other examples alternative current monitors may be used. As further set out below, determining a rate of change of current consumption of the pump 102 may comprises determining a rate of change of the current consumption over a particular time period, for example after an initial time period in which transient current effects may be seen.

In some examples, a cleaning operation may include using the printhead maintenance apparatus 100 to change the internal pressure of the printhead. The pump 102 may for example pump air (which may be atmospheric air or any other gas) into an expandable chamber within a printhead, so as to displace print agent (e.g. ink) within the printhead through the nozzles, purging them of debris. In some examples, this may mean sealing an opening in a fluid (for example, air) delivery passage. Such an opening may generally be open during a print operation in which print agent is to be ejected onto a substrate, build material or the like. The expandable chamber may be a inflating bag or bellows like structure: as more air enters the expandable chamber, it inflates and the internal printhead pressure (which is now a positive pressure with respect to the external pressure) displaces print agent, which is forced to flow through print agent delivery tubes and exit the printhead through the nozzles, effectively cleaning them.

Figure 2:
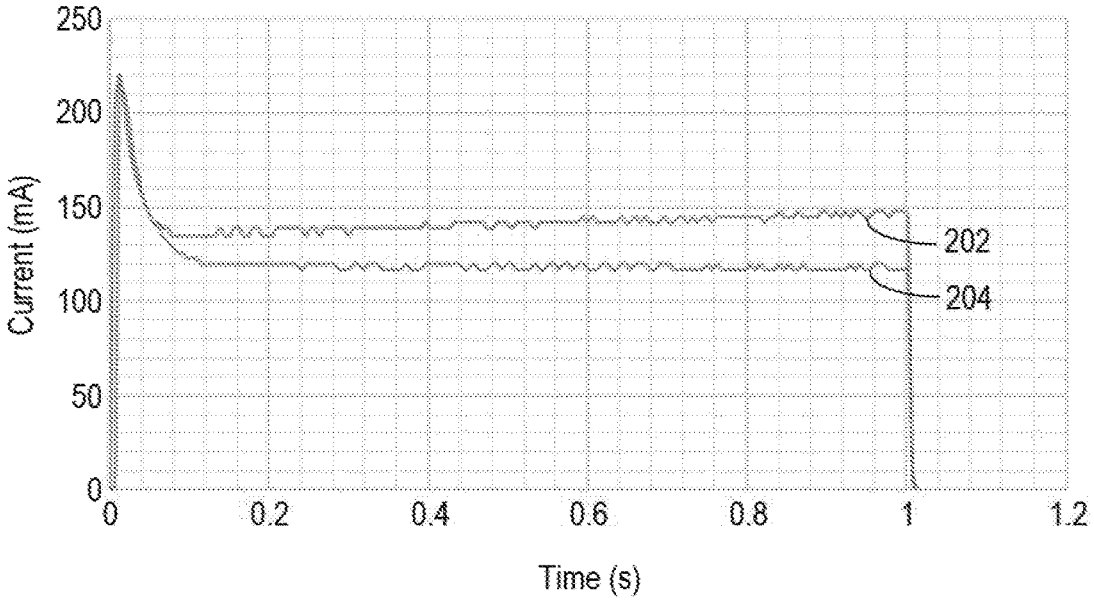
FIG. 2 is an example graph of currents measured during use of printhead maintenance apparatus.

FIG. 2 is a graph showing examples of the current consumption of a printhead maintenance apparatus 100 over time in an example in which the pump 102 is to pump air into an expandable chamber in a printhead. Line 202 shows the current consumption of a printhead maintenance apparatus 100 functioning as intended, with any opening in a passage between the pump 102 and the printhead being sealed. As can be seen, after an initial transient period, as the pump 102 operates to fill the expandable chamber within the printhead with air, its current consumption increases. This is because, as the pressure inside the printhead increases, the resistance experienced by the pump 102 increases and thus the energy consumption of the pump 102 to continue to operate also increases. Line 204 shows the current in the event of a leak. This may be a leak between the pump 102 and a printhead, or may indicate that a delivery passage has not been sealed, or the like. As may be noted, this line 204 is flatter, i.e. its gradient is lower (approximately zero).

In some examples, this current may be monitored as part of a cleaning process. In other examples, the current may be monitored as part of a testing process.

As set out above, the processing circuitry 106 is to determine the rate of change of current consumption of the pump 102 and to compare the rate of change of current consumption to a predetermined threshold. This may allow a determination as to whether the apparatus is functioning as intended and/or to detect if there are leaks in the system.

For example, the current consumption (after the initial transient period) of line 202 may be characterised as having the form:

Y=K+X*B, where X is the number of current samples obtained by the current monitor 104 and Y is the current consumption measured by the current monitor 104. K is an offset (which may be determined) and B is a gradient to be determined as this is indicative of the rate of change of current consumption.

To estimate the parameters K and B, a linear regression method and least squares criteria may be used.

$$B = \frac{\mathrm{Cov}[x, y]}{\mathrm{Var}[x]} = \frac{\Sigma x_i y_i - \frac{1}{n}\Sigma x \Sigma y}{\Sigma x_i^2 - \frac{1}{n}(\Sigma x_i)^2}$$

and $$K = \bar{y} - B\bar{x}.$$

where $\bar{x}, \bar{y}$ is the mean of vector x and y respectively.

In order to determine the rate of change of current after the transient period, B may be determined. As noted above, if the apparatus is functioning as intended, B is expected to be a positive value (i.e. the threshold value is at least 0), and the rate of change of current is expected to exceed 0 for a leak-free system. The determined value of B may be compared to a value which is greater than 0. For example, this may allow smaller leaks (i.e. leaks which mean that air is lost slower than the pump 102 can replace it) to be detected. The value of the threshold may be determined in a calibration exercise. For example, a calibration exercise may be carried out using a fully functioning printhead and a leak-free system and a value of B may be determined. The threshold may, for example, be set based on this value. For example, the threshold may be around 10%, 15% or 25% lower than the value of B determined during calibration, to allow for some degradation in pump performance and measurement error but to allow smaller leaks to be detected. The actual threshold may vary between apparatus. In some examples, a statistical analysis of historical data may be used to determine thresholds which provide an appropriate compromise between failing to detect a leakage and detect a false leakage.

Figure 3:
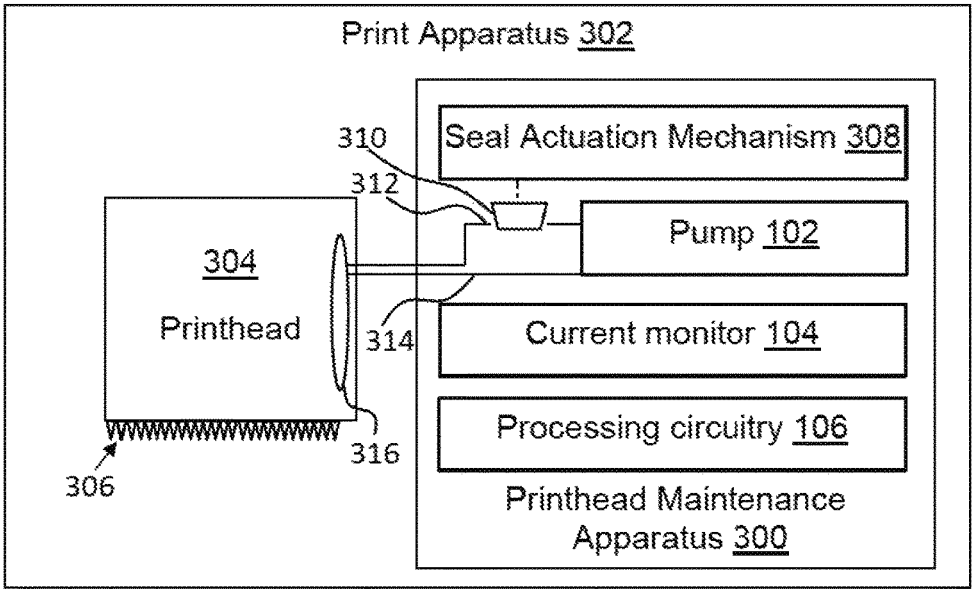
FIGS. 3 and 4 are schematic examples of print apparatus.

FIG. 3 shows another example of a printhead maintenance apparatus 300, which in this example is shown in a print apparatus 302 in which a printhead 304 (which may be a removable or replaceable component) is installed, for example in a printhead carriage. The print apparatus 302 may be a two- or three-dimensional print apparatus. The printhead 304 comprises a plurality of nozzles 306.

In this example, in addition to the components described in FIG. 1 (which are labelled with like numbers), the printhead maintenance apparatus 300 comprises a seal actuation mechanism 308. The seal actuation mechanism 308 is to actuate a seal 310 to block an opening 312 in a fluid delivery passage 314 delivering, in this example, air from the pump 102 to the printhead 304. In this example, the opening 312 is provided in an air delivery passage 314 between the pump 102 and an expandable chamber 316, i.e. the pump 102 is to pump air into the expandable chamber 316, which comprises a bag-like structure, which is within the printhead 304. For example, the seal 310 may comprise a solenoid valve and the seal actuation mechanism 308 may supply an electrical signal to the solenoid valve to close and/or open the opening 312. In other examples, the seal actuation mechanism 308 may for example be a mechanical, electrical or magnetic actuator, or some other actuator.

In some examples, the delivery passage 314 may further comprise a pressure relief valve to operate in the event of an over-pressure.

In use of the print apparatus 300 for printing operations, the opening 312 may be open such that the pressure inside the expandable chamber is equalised to atmospheric pressure. By closing the opening 312, the pressure in the expandable chamber 316 may be increased by the pump 102, causing it to expand and the fluid in the printhead 304 may be displaced and forced to pass through at least one nozzle 306 of the printhead 304. Thus, for cleaning operations, the opening 312 may be sealed.

In this example, the processing circuitry 106 determines, in addition to a rate of change of the current consumed, at least one indication of an average current consumption while the pump 102 is in operation, and an indication of current consumption of the seal actuation mechanism 308 when the pump 102 is inactive. An indication of average current consumption while the pump 102 is in operation is determined when the seal 310 is blocking the opening 312, and when the opening 312 is unblocked.

The processing circuitry 106 may compare each of the average current consumption of pump 102 when the opening 312 is unblocked (i.e. seal actuation mechanism 308 is inactive) and the current consumption of the seal actuation mechanism 308 when the pump 102 is inactive to separate predetermined thresholds. This allows testing of the components in isolation. By providing a seal actuation mechanism 308 which operates separately to the pump 102, the operational status of the pump 102 in isolation to the seal actuation mechanism 308 may be determined without requiring physical intervention by a user, for example to release a latch on a printhead 304, thus allowing air to enter the interior. It also allows the operational status of the seal actuation mechanism 308 to be determined independently of the operational status of the pump 102.

In this way, the seal actuation mechanism 308 may be driven to place the seal 310 into the opening 312 while the pump 102 is idle. The current monitor 104 may measure the current consumption of the printhead maintenance apparatus 300. This will not result in any print agent or fluid flow through the nozzles 306. This current consumption over at least a portion of the operation provides a seal actuation mechanism test signal.

At a different time, the pump 102 may be operated with the opening 312 unblocked, and the current monitor 104 may measure the current consumption of the printhead maintenance apparatus 300. Again, this will not result in any fluid flow through the nozzles 306 as the expandable chamber 316 does not expand so there is no internal pressure build up in the printhead 304. This may produce a trace similar to the line 204 described in relation to FIG. 2 above. The average current consumption of pump 102 over at least a portion of its operation (in some examples, the average after a transient period) provides a pump test signal.

Each of the seal actuation mechanism test signal and the pump test signal may be compared to an expected current consumption for that component, and the processing circuitry 106 may determine if the test signals are within a predetermined range thereof (i.e., the test signal may be compared to an upper and a lower threshold). For example, if one of these signals indicates that the current consumption is lower than anticipated, this may be an indication that the component is not operational. Conversely, if the current consumption is too high this may be an indication that there is a short circuit or some other electrical or mechanical fault.

If the test signals indicate that the current consumption of both the seal actuation mechanism 308 and the pump 102 is within a predetermined threshold range, then a calibration value of the printhead maintenance apparatus 300 may be determined as the sum of the current consumption of both components. For example, if the average consumption of the seal actuation mechanism 308 is 75 mA and the average current consumption of the pump is 90 mA, the calibration value may be set to 165 mA. Thus, each of the seal actuation mechanism 308 and the pump 102 may be tested in-situ, without being removed from the print apparatus 302, and without requiring the print apparatus 302 to be taken off-line.

Once the calibration is performed, a cleaning operation may be conducted by activating the seal actuation mechanism 308 to close the opening 312 and activating the pump 102 simultaneously and measuring the current consumption of the printhead maintenance apparatus 300, as described in relation to FIGS. 1 and 3 above. When both the seal actuation mechanism 308 and the pump 102 are activated simultaneously, the print agent contained within the printhead 304 will be forced through the tubes and nozzles 306, effectively cleaning the printhead 304.

In this example, in addition to determining the rate of change of the current in the portion of operation following the period in which transient currents are seen, the processing circuitry 106 uses the measurements obtained by the current monitor 104 during the cleaning operation to determine an average current during the cleaning operation, and this is compared to the calibration value. In addition to testing the operation of both the pump 102 and the seal actuation mechanism 308 independently, this tests them together, in some examples during an actual cleaning operation.

In such an example, the processing circuitry 106 may filter out the transient region of the current consumption signal (for example, considering the graph of FIG. 2, the first 0.2 seconds). Then, processing circuitry 106 may compute the average of the data in the stable region (from around 0.2 seconds to 1.0 second in FIG. 2). In the example of FIG. 2, the average (mean) current consumption for this period is 140 mA. Next, this may be compared to a value based on the calibration value 165 mA (for example, the value may be a little lower to allow for measurement and operational variation). If the average current consumption is above a value based on the calibration value (or in some examples, within a predetermined range of the calibration value), then the printhead maintenance apparatus 300 may be considered to be fully operational (and, if the current values are determined during a cleaning operation, that cleaning operation may be determined to have been successful). Otherwise, as in this example, the printhead maintenance apparatus 300 is considered to be a fault condition.

In some examples, such a calibration value may be determined at various points over the life of a print apparatus. This allows an 'up-to-date' calibration value to be used. For example, the current consumption of seal actuation mechanism 308 and/or the pump 102 may change over time due to component degradation. For example, if the current consumption decreases over time, unless the calibration value is updated, a printhead maintenance apparatus 300 may be determined to be at fault when in fact the printhead maintenance apparatus 300 is operating as intended. In addition, if up-to-date tests of the individual components have been carried out and used to determine a calibration value, an average current consumption which is below the calibration value (or a value based thereon) may be more likely to be indicative of a leak than of a fault in one of the components.

In general, an average current measured during a cleaning operation which is outside of a predetermined range of a calibration value may be indicative of a fault in the printhead maintenance apparatus as it may indicate that at least one component is operating outside normal operational ranges.

In some examples, the calibration value may be determined just before a cleaning operation, for example such that a temperature condition is substantially the same for both calibration and cleaning operations. This allows the instant conditions to be taken into account. For example, if the calibration is carried out when the print apparatus 302 is at a relatively high temperature, the calibration value determined will tend to be higher (as the internal resistance of the components increases with temperature and thus the current consumption at a specific voltage for a hotter component is higher that when that component is cooler). Therefore, the calibration will take into account not just the present state of the pump 102 and the seal actuation mechanism 308 but also the instant ambient conditions. As such, false fault detections and missed fault detections may be reduced by determining the calibration value immediately before a cleaning operation.

In some examples, the processing circuitry 106 is to generate an alert if any of either test signal, the average current during the cleaning operation or the rate of change of current consumption is outside a threshold range (i.e. is outside a range determined by a higher and lower threshold). For example this may be an audible or a visible alert. In some examples, the alert may be generated at a remote location, for example based on information sent over the Internet or the like. The alert may indicate which test has resulted in a value which is outside a threshold range, and/or may indicate, based on this, an expected fault. This may allow a user to determine if there may be a fault in the seal actuation mechanism 308, the pump 102, or if a leakage has occurred. This in turn simplifies diagnostics and troubleshooting, and may reduce intervention time and cost as the defective part may be identified and replaced without inspection of the printhead maintenance apparatus 300 outside the print apparatus 302, and/or potentially replacement of the printhead maintenance apparatus 300 in its entirety.

Thus the printhead maintenance apparatus 300 has a number of 'self-test' facilities, which may be employed separately or in conjunction. Each of the seal actuation mechanism 308 and the pump 102 may be tested separately to determine if their current consumption is within an anticipated range. Both of the seal actuation mechanism 308 and the pump 102 may be tested together, for example during an actual cleaning operation to determine if the current consumption is within an anticipated range. Finally, a leak detection may be made based on the rate of change of current consumption while the pump 102 is in use to increase the pressure in a printhead (which may be during an actual cleaning operation).

While each test may increase the confidence in fault detection, combining these 'self-test' facilities increases the confidence of fault detection on a cumulative basis.

Figure 4:
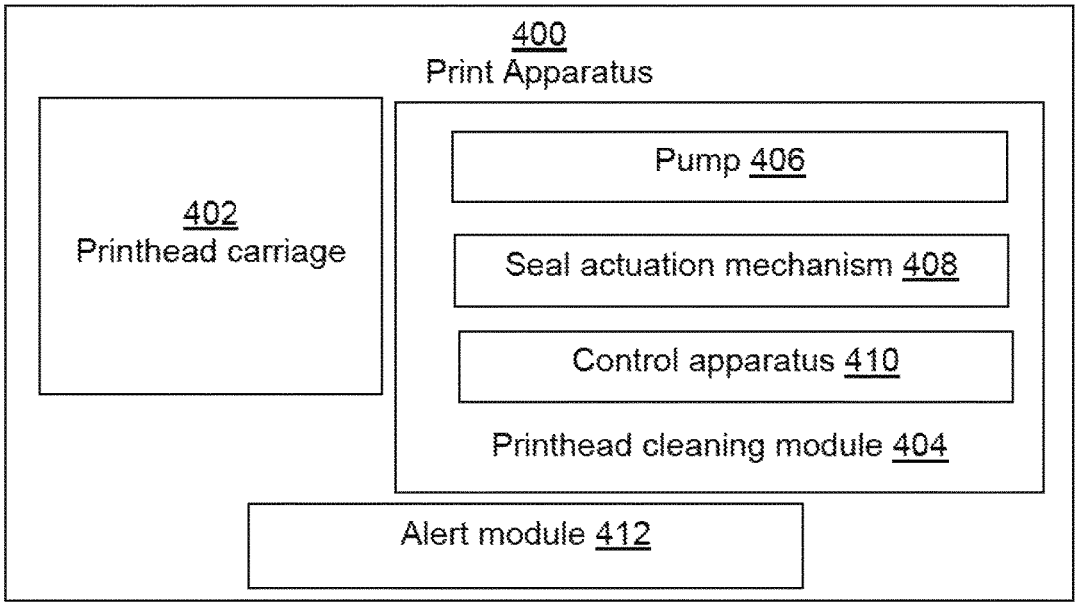

FIG. 4 shows another example of a print apparatus 400. The print apparatus 400 comprises a printhead carriage 402 and a printhead cleaning apparatus 404. The printhead cleaning apparatus 404 may be an example of a printhead maintenance apparatus as described in relation to FIG. 1 or 3. In this example, the printhead cleaning apparatus 404 comprises a pump 406, which is to increase the pressure in a printhead mounted in the printhead carriage 402, and a seal actuation mechanism 408 to actuate a seal to block an opening in a delivery passage connecting the pump 406 to a printhead (for example, as illustrated in FIG. 3. The printhead cleaning apparatus 404 also comprises control apparatus 410. The control apparatus 410 is to activate the pump 406 and the seal actuation mechanism 408 individually to test the printhead cleaning apparatus 404 and simultaneously to perform a cleaning operation on a printhead. Thus, the printhead cleaning apparatus 404 may be controlled to provide individual test signals as described above in relation to FIG. 3. Such test signals provide a means for checking the functions of the components of the printhead cleaning apparatus 404 individually, and can in some examples provide a calibration value.

While in some previous printhead cleaning apparatus it has been proposed to couple the activation of the pump 406 and the seal actuation mechanism 408, in this example, the activation of these components is decoupled, allowing for individual testing. The pump 406 and the seal actuation mechanism may have any of the attributes or characteristics of the pump 102 described in relation to FIGS. 1 and 2 or the seal actuation means described in relation to FIG. 2.

In some examples, the print apparatus 400 may further comprise a current monitor, for example a current monitor 104 and/or processing circuitry 106 as described in relation to FIGS. 1 to 3. In some examples, such a current monitor 104 may monitor the current consumed by each of the pump 406 and the seal actuation mechanism 408 to test the printhead cleaning apparatus 404. In some examples, such a current monitor 104 may be a current monitor to monitor the current consumed in a cleaning operation on the printhead, such that the print apparatus 406 (for example, processing circuitry thereof, which may in some examples be processing circuitry 106 as described above) may determine at least one of (i) an indication of leakage based on the rate of change of the current consumption and (ii) an indication of effectiveness of the cleaning operation (e.g. the operational status of the pump and sealing mechanism) based on an average current consumed in a cleaning operation. This determination may be based on a current over at least a portion of a cleaning operation, for example after any transient currents have occurred.

In this example, the print apparatus 400 also comprises an alert module 412 to generate an alert if a test of the printhead cleaning apparatus 404 is indicative of failure, for example if the rate of change is above a threshold or if determined an average current consumption is outside a predetermined range. However, in other examples, there may be no alert module, or the alert may be generated remotely.

Figure 5:
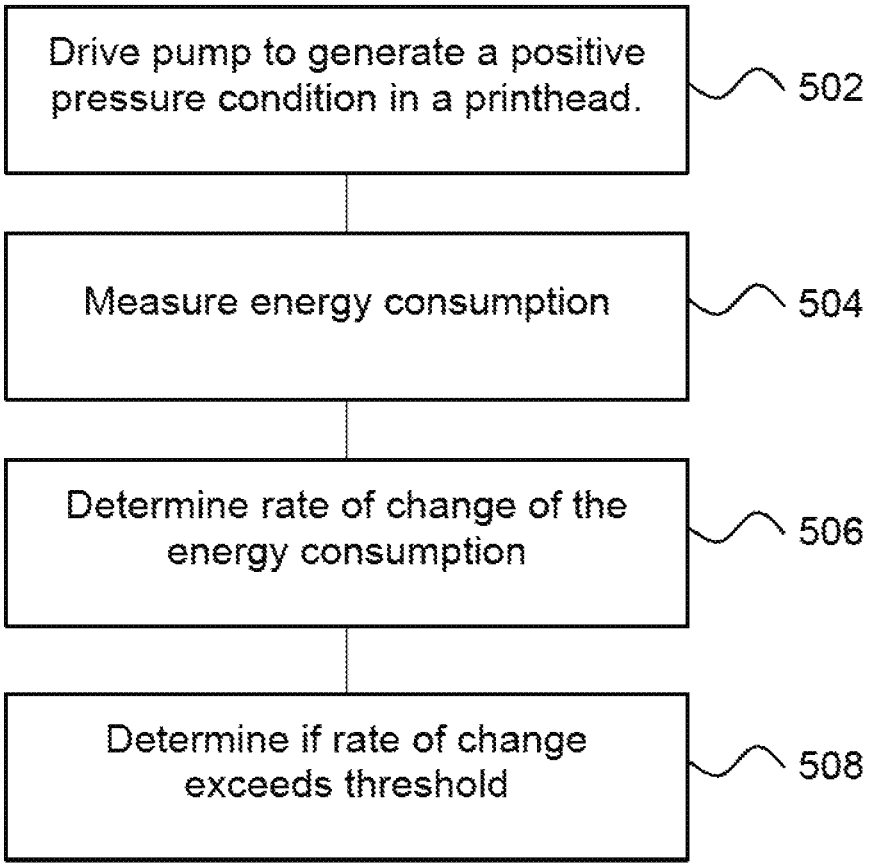
FIG. 5 is a flowchart of an example method of determining a rate of change of current consumption.

FIG. 5 is an example of a method, which may be a method of detecting leaks in a system comprising a printhead maintenance and/or cleaning apparatus, comprising, in block 502, driving a pump to generate a positive pressure condition in a printhead of a print apparatus. The positive pressure condition sought may be positive with respect to the local atmospheric pressure. Any pressure condition which will tend to urge fluids within the printhead to exit the printhead through any opening (for example, through inkjet nozzles) may be a positive pressure condition. For example, air or some other fluid may be pumped into the printhead. In some examples, fluid may be pumped into an expandable chamber within the printhead. Generating the positive pressure may comprise sealing a delivery passage connecting the pump to the printhead an operating the pump.

Block 504 comprises measuring an energy consumption in driving the pump. For example, this may comprise determining a current consumption for at least of a portion of a time over which the pump is driven, as detailed above.

Block 506 comprises determining, for example using at least one processor, a rate of change of the energy consumption. As noted above, the rate of change may be indicative of whether a leak is present in the system (i.e. whether a positive pressure condition is being generated as anticipated). The rate of change may be a rate of change of the energy consumption for just part of the period in which the positive pressure exists. This may allow transient conditions to be filtered out.

Block 508 comprises determining (for example using at least one processor) if the rate of change of energy consumption is greater than a predetermined threshold. For example this may comprise determining a value for B in the equations above and comparing this to at least one threshold value. In some examples, if the rate of change of energy consumption is less than the predetermined threshold, the method may comprise determining that a leak has occurred. Conversely, if the rate of change of energy consumption is greater than a predetermined threshold, the method may comprise determining that no leak has occurred.

The method may be carried out during a cleaning operation of the printhead.

Figure 6:
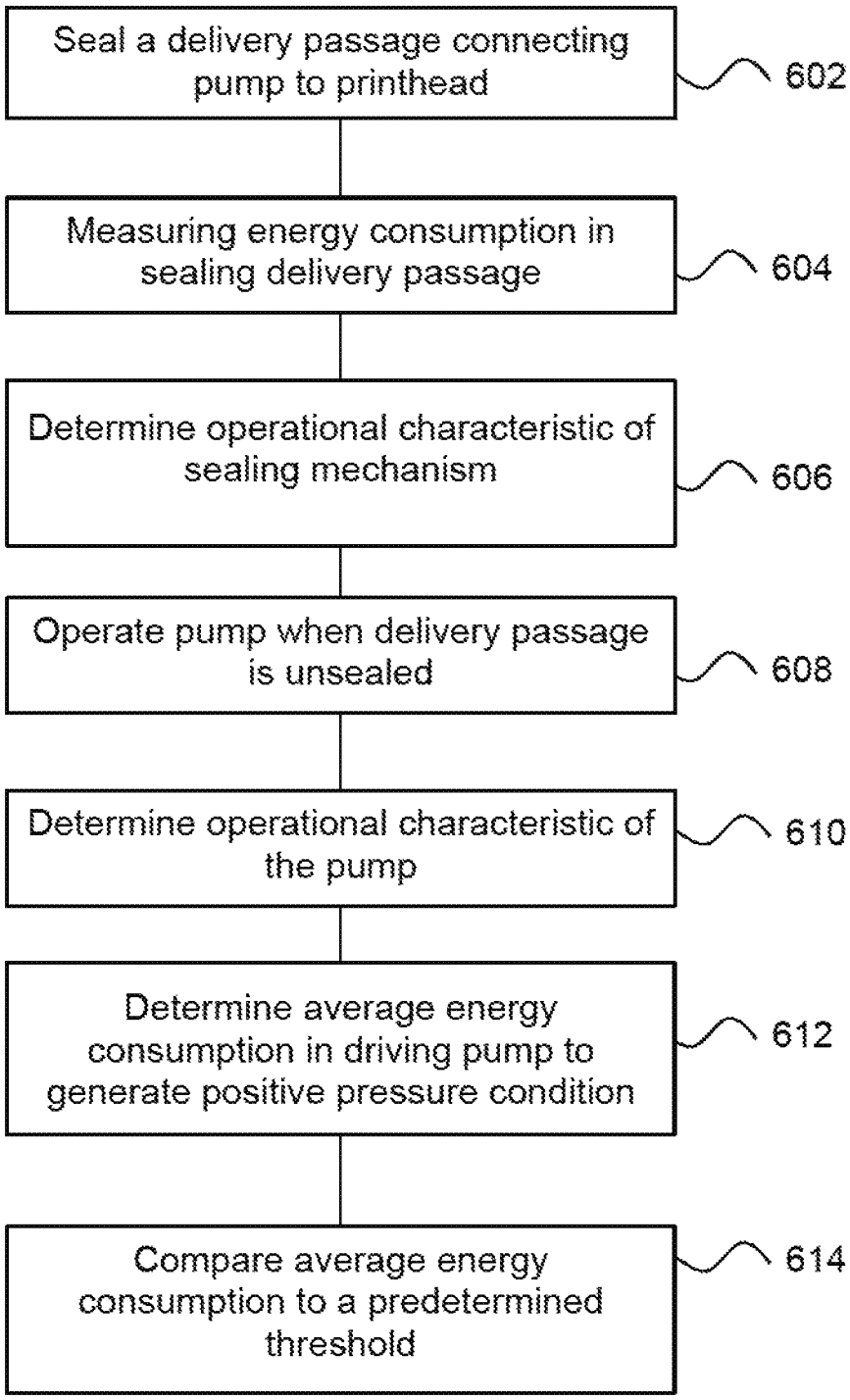
FIG. 6 is a flowchart of an example of a method of determining operational characteristics of components in printhead maintenance and/or cleaning apparatus.

FIG. 6 is another example of a method, which may be carried out in conjunction with blocks 502 to 508. Block 602 comprises sealing a delivery passage connecting a pump to the printhead. Block 604 comprises measuring an energy consumption in sealing the delivery passage and block 606 comprises determining an operational characteristic of the sealing mechanism based on the measurement. For example the operational characteristic may be based on the energy (for example, current) consumed in forming the seal. In some examples, the energy consumed may be compared to an anticipated energy consumption and the operational characteristic may comprise determining whether the energy consumed is within a predetermined range of an anticipated energy consumption, and, if so, determining if the sealing mechanism is operating as anticipated and if not, determining that a fault condition exists. In such examples, the operational characteristic may be an indication of a fault or non-fault condition.

Block 608 comprises operating a pump when a delivery passage connecting a pump to the printhead is unsealed and block 610 comprise determining an operational characteristic of the pump. For example, this may comprise measuring an energy consumption in operating the pump and determining the energy consumed thereby for at least part of that operation. In some examples, the operational characteristic may be determined based on the energy (for example, current) consumed in operating the pump. In some examples, the energy consumed may be compared to an anticipated energy consumption and determining the operational characteristic may comprise determining if the energy consumed is within a predetermined range of anticipated energy consumption, and, if so, determining if the pump is operating as anticipated and if not, determining that a fault condition exists. In such examples, the operational characteristic may be an indication of a fault or non-fault condition.

In block 612, an average energy consumption in driving the pump to generate a positive pressure condition is determined (noting that, in order to generate a positive pressure condition, any sealing mechanism may be used to seal the delivery), and block 614 comprises comparing the average energy consumption to a predetermined threshold. As has been set out above, this may allow a printhead maintenance and/or cleaning apparatus to perform a 'self-test', i.e., may provide an indication that the components thereof are functioning correctly, and therefore provide confidence that a cleaning operation has been performed as intended. If the average consumption is below the threshold, this may be indicative of a system fault and, in some examples, an alert may be generated. In some examples, an operational characteristic may be determined and may comprise an indication of a fault or non-fault condition.

Some aspects of examples in the present disclosure can be provided as methods, systems or a combination of machine readable instructions and circuitry to execute the machine readable instructions. Such machine readable instructions may be included on a computer readable storage medium (including but is not limited to disc storage, CD-ROM, optical storage, etc.) having computer readable program codes therein or thereon.

The present disclosure is described with reference to flow charts and block diagrams of the method, devices and systems according to examples of the present disclosure. Although the flow diagrams described above show a specific order of execution, the order of execution may differ from that which is depicted. Blocks described in relation to one flow chart may be combined with those of another flow chart. It shall be understood that some flow and/or block in the flow charts and/or block diagrams, as well as combinations of the flows and/or diagrams in the flow charts and/or block diagrams can be realized by machine readable instructions.

The machine readable instructions may, for example, be executed by a general purpose computer, a special purpose computer, an embedded processor or processors of other programmable data processing devices to realize the functions described in the description and diagrams. In particular, a processor or processing apparatus may execute the machine readable instructions. Thus functional modules of the apparatus and devices (for example the processing circuitry 106, the control apparatus 410 and/or the alert module 412) may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors.

Such machine readable instructions may also be stored in a computer readable storage that can guide the computer or other programmable data processing devices to operate in a specific mode.

Such machine readable instructions may also be loaded onto a computer or other programmable data processing devices, so that the computer or other programmable data processing devices perform a series of operations to produce computer-implemented processing, thus the instructions executed on the computer or other programmable devices realize functions specified by flow(s) in the flow charts and/or block(s) in the block diagrams.

Further, some teachings herein may be implemented in the form of a computer software product executed by a computer device, the computer software product being stored in a storage medium and comprising a plurality of instructions for making the computer device implement the methods recited in the examples of the present disclosure.

While the method, apparatus and related aspects have been described with reference to certain examples, various modifications, changes, omissions, and substitutions can be made without departing from the spirit of the present disclosure. It is intended, therefore, that the method, apparatus and related aspects be limited only by the scope of the following claims and their equivalents. It should be noted that the above-mentioned examples illustrate rather than limit what is described herein, and many alternative implementations may be designed without departing from the scope of the appended claims. Features described in relation to one example may be combined with features of another example. For example, printhead maintenance apparatus 100 may have any of the features of the printhead maintenance apparatus 300 described in FIG. 3, and vice versa. Either printhead maintenance apparatus 100, 300 may have any of the features of the printhead cleaning apparatus 404, and vice versa. Either of the print apparatus 300, 400 may have any feature of the other print apparatus, and so on.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A printhead maintenance apparatus comprising a pump, a current monitor and processing circuitry, wherein:

the pump is to increase a pressure in a printhead;

the current monitor is to monitor a current consumption of the pump; and the processing circuitry is to determine a rate of change of current consumption of the pump and to compare the rate of change of current consumption to a predetermined threshold.

2. A printhead maintenance apparatus according to claim 1 in which the processing circuitry is to generate an alert if the rate of change of current consumption is less than the predetermined threshold.

3. A printhead maintenance apparatus according to claim 1 in which the processing circuitry is to determine an indication of an average current consumption while the pump is in operation and to compare the average current consumption to a predetermined threshold.

4. A printhead maintenance apparatus according to claim 1 further comprising a seal actuation mechanism, wherein the seal actuation mechanism is to actuate a seal to seal a delivery passage to connect the pump to the printhead.

5. A printhead maintenance apparatus according to claim 4 in which the current monitor is to determine the current consumption of the seal actuation mechanism when the pump is inactive, and the processing circuitry is to compare the current consumption to a predetermined threshold.

6. A printhead maintenance apparatus according to claim 4 in which the current monitor is to determine the current consumption of the pump when the delivery passage is unsealed and the processing circuitry is to compare the current consumption to a predetermined threshold.

7. A print apparatus comprising a printhead carriage and a printhead cleaning apparatus, the printhead cleaning apparatus comprising:

a pump to increase a pressure in a printhead mounted in the printhead carriage; and a seal actuation mechanism to actuate a seal to block an opening in a delivery passage connecting the pump to the printhead; and control apparatus, wherein the control apparatus is to activate the pump and the seal actuation mechanism individually to test the printhead cleaning apparatus and simultaneously to perform a cleaning operation on a printhead.

8. A print apparatus according to claim 7 further comprising a current monitor to monitor a current consumption of each of the pump and the seal actuation mechanism to test the printhead cleaning apparatus.

9. A print apparatus according to claim 7 further comprising a current monitor to monitor a current consumption in a cleaning operation on the printhead, wherein the print apparatus is to determine at least one of:

an indication of leakage based on a rate of change of current consumption; and an indication of effectiveness of the cleaning operation based on an average current consumed in a cleaning operation.

10. A print apparatus according to claim 7 which comprises an alert module to generate an alert if the test of the printhead cleaning apparatus is indicative of a failure.

11. A method comprising:

driving a pump to generate a positive pressure condition in a printhead of a print apparatus;

measuring an energy consumption in driving the pump;

determining, using a processor, a rate of change of the energy consumption; and determining, using the processor, if the rate of change of the energy consumption is greater than a predetermined threshold.

12. The method of claim 11 further comprising determining, using the processor, an average energy consumption in driving the pump and comparing the average energy consumption to a predetermined threshold.

13. The method of claim 11 further comprising sealing a delivery passage connecting the pump to the printhead and driving the pump to generate the positive pressure condition while the delivery passage is sealed.

14. The method of claim 11 further comprising sealing a delivery passage connecting a pump to the printhead;

measuring an energy consumption in sealing the delivery passage; and determining an operational characteristic of a sealing mechanism based on the measurement.

15. The method of claim 11 further comprising determining, using the processor, an operational characteristic of the pump by operating the pump when a delivery passage connected to the pump is unsealed.

* * * * *